US006457530B1

(12) United States Patent
Lam et al.

(10) Patent No.: US 6,457,530 B1
(45) Date of Patent: Oct. 1, 2002

(54) WELLHEAD PRODUCTION PUMPING TREE

(75) Inventors: Tony M. Lam, Edmonton (CA); Keith D. Farquharson, Edmonton (CA); Daniel J. Riddell, Edmonton (CA)

(73) Assignee: Stream-Flo Industries, Ltd., Edmonton (CA)

( * ) Notice: Subject to any disclaimer, the term of this patent is extended or adjusted under 35 U.S.C. 154(b) by 35 days.

(21) Appl. No.: 09/816,274

(22) Filed: Mar. 23, 2001

(51) Int. Cl.[7] ..... E21B 33/43

(52) U.S. Cl. ..... 166/368; 166/242.5; 166/88.4; 166/77.1

(58) Field of Search ..... 166/242.2, 77.1, 166/88.1, 88.4, 85.4, 68.5, 368

(56) References Cited

U.S. PATENT DOCUMENTS

| | | | | | |
|---|---|---|---|---|---|
| 1,362,718 | A | * | 12/1920 | McNamara | 285/125.1 |
| 1,659,452 | A | * | 2/1928 | Welton | 138/37 |
| RE19,047 | E | * | 1/1934 | Hinderliter | 166/85.4 |
| 1,963,046 | A | * | 6/1934 | Bouslog | 166/88.2 |
| 3,050,126 | A | * | 8/1962 | Lebeaux et al. | 137/861 |
| 4,169,504 | A | * | 10/1979 | Scott | 166/90.1 |
| 4,506,729 | A | * | 3/1985 | Davis et al. | 166/242.5 |
| 5,012,865 | A | * | 5/1991 | McLeod | 166/90.1 |
| 5,522,464 | A | * | 6/1996 | Piper | 166/212 |
| 5,617,917 | A | * | 4/1997 | Squires | 166/85.4 |
| 5,743,332 | A | * | 4/1998 | Lam et al. | 166/379 |
| 5,775,420 | A | * | 7/1998 | Mitchell et al. | 166/313 |
| 5,988,282 | A | * | 11/1999 | Jennings et al. | 166/348 |
| 6,050,339 | A | * | 4/2000 | Milberger | 166/348 |
| 6,223,819 | B1 | * | 5/2001 | Heinonen | 166/368 |
| 6,269,879 | B1 | * | 8/2001 | Boyd | 166/242.5 |
| 6,364,024 | B1 | * | 4/2002 | Dallas | 166/379 |

FOREIGN PATENT DOCUMENTS

| | | |
|---|---|---|
| CA | 2197584 | 7/1998 |
| CA | 2268223 | 2/2000 |

* cited by examiner

*Primary Examiner*—Thomas B. Will
*Assistant Examiner*—Thomas A. Beach
(74) *Attorney, Agent, or Firm*—Sheridan Ross PC

(57) ABSTRACT

A monolithic pumping tree combining a bottom connection, production blow-out preventer section, flow tee section and top connection is cast so as to provide an access port extending downwardly through the side wall of the tree from its outer surface, to connect with either the central vertical bore of the tree or its horizontal bottom surface, thereby enabling coiled tubing to be inserted either into the tubing string bore or into the annulus between the tubing and production casing strings.

3 Claims, 5 Drawing Sheets

WELLHEAD PRODUCTION PUMPING TREE

FIELD OF THE INVENTION

The present invention relates to a wellhead component having an access port through which coiled tubing can be inserted into the bore of the tubing string or, alternatively, into the annulus between the tubing string and the production casing of a well.

BACKGROUND OF THE INVENTION

Canadian patent No. 2,197,584 discloses a wellhead component which is referred to as a composite pumping tree. This pumping tree is shown in FIG. 1. It typically is used by incorporating it into a wellhead equipped with a rotary drive assembly for rotating a rod string connected with a downhole rotary or screw pump (see FIGS. 4 and 5).

This known pumping tree a comprises a monolithic housing b formed from a single piece of steel. It may be forged or cast. The housing has a vertical bore c extending therethrough and comprises:

- a bottom connection d, which can be studded or flanged or of the threaded ring or clamp and hub type. The bottom connection is operative to connect with the top connection of the wellhead tubing head;
- a production blowout preventer ("BOP") housing section e forming side openings f communicating with the vertical bore c, for receiving the ram components g of a BOP;
- a flow tee section h forming at least one side opening i communicating with the bore c, for producing well fluid; and
- a top connection j, preferably studded and internally threaded, for connecting with the stuffing box and frame of a rotary drive assembly for sealing and rotating the rod string.

The pumping tree a is free of narrow necks and has a substantially consistently thick side wall k.

The wellhead assembly shown in FIG. 1 is commonly used in connection with wells producing heavy oil from a sand formation. With some of these wells it is necessary to periodically insert a small diameter coiled tubing string into the production tubing string bore or into the annulus between the tubing string and the production casing. This may be done, for example, for the purpose of circulating fluid through the well to wash out sand bridges or plugs which have built up downhole. Alternatively, there are also occasions when it may be desirable to run pressure or temperature measuring instruments into the well on coiled tubing.

In the past, when a coiled tubing string or instrumentation string was to be run into a well, it was the conventional practice:

- to unbolt and remove the rotary drive assembly; and
- then mount a special spool in its place, the spool having one or more angled side ports through which the coiled tubing or instrumentation string could be inserted.

This prior practice was time consuming and involved cost. It also produced a relatively high assembly which a service rig might not correlate with.

SUMMARY OF THE INVENTION

In accordance with the present invention, a composite pumping tree is modified by providing an access port extending inwardly and downwardly through the side wall from the tree's outer surface to either the vertical bore or to the tree's bottom surface. The access port terminating at the vertical bore makes it possible to insert a coiled tubing string into the bore of the tubing string. The access port terminating at the bottom surface of the tree, when coupled with an opening extending through the tubing string hanger, enables insertion of coiled tubing into the annulus between the production casing and tubing string. Preferably an inlet pipe extends upwardly and outwardly from the access port. The inlet pipe may be a nipple threaded into the access port or it may be integral with the tree. A control valve is mounted to the inlet pipe.

The main advantages of the assembly are that:

- it does away with the need to first remove the bulky rotary drive assembly and then insert a spool, when coiled tubing is to be inserted; and
- it keeps the access port relatively low, so that the service rig equipment is better able to work with it.

DESCRIPTION OF THE PREFERRED EMBODIMENT

Figure 1:
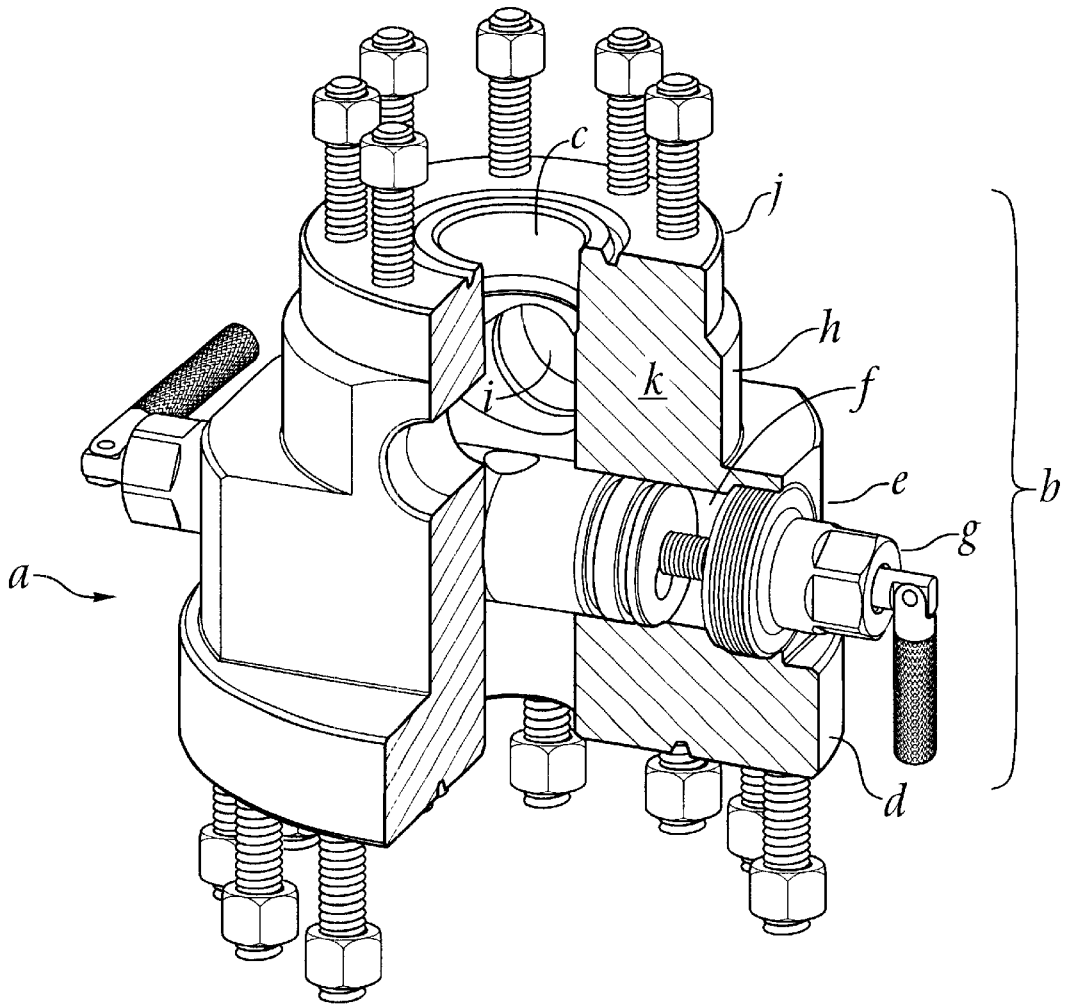
FIG. 1 (Prior Art)
FIG. 1 is a partly cross-sectional side view of a prior art composite pumping tree.

Having reference to the Figures, the composite pumping tree 1 is forged or cast as a monolithic unit formed from a single piece of steel. The tree 1 comprises a housing 2 having a vertical bore 3 extending therethrough. The housing 2 comprises a bottom connection 4, a BOP housing section 5, a flow tee section 6, a top connection 7 and an access port 8 and inlet pipe 9.

The bottom connection 4 is flanged and studded. It is adapted to connect and seal with the top connection 10 of a tubing head 11 forming part of a conventional pumping wellhead 12 of a well 13. The bottom face 14 of the bottom connection 4 forms a ring seal groove 15, extending around the vertical bore 3, for receiving a seal ring 16. The body of the connection 4 forms threaded bolt holes (not shown) for receiving connecting studs 18. The bottom connection 4 enables mounting of the pumping tree 1 to the tubing head 11.

The BOP housing section 5 extends up from the bottom connection 4. As shown, the BOP housing section 5 is contiguous with the bottom connection 4 so that there is no narrowing neck between them. The section 5 forms diametrically aligned side openings 19 communicating or connecting with the vertical bore 3. The side openings 19 are internally threaded and formed to receive the ram components 20 of a side-opening production BOP.

The flow tee section 6 extends up from the BOP housing section 5. As shown, the BOP housing section 5 is contiguous with the flow tee section 6 so that there is no narrowing neck between them. The flow tee section 6 forms internally threaded side openings 21 communicating with the vertical bore 3. The side openings 21 form outlet means for tying in to a flow line 60, through which well fluid is produced.

A studded top connection 7 extends up from the flow tee section 6. The end face 22 of the top connection 7 forms a ring seal groove 23 for receiving ring seal 26. The body of the top connection 7 is preferably internally threaded and forms threaded bolt holes 24 for receiving studs 25. The top connection 7 is adapted to seal and connect with stuffing box 27 and frame 28 of a rotary drive assembly 29.

The top connection 7 may have a smaller diameter than the main body of housing 2 and therefore forms a shoulder 30 therewith.

Figure 2:
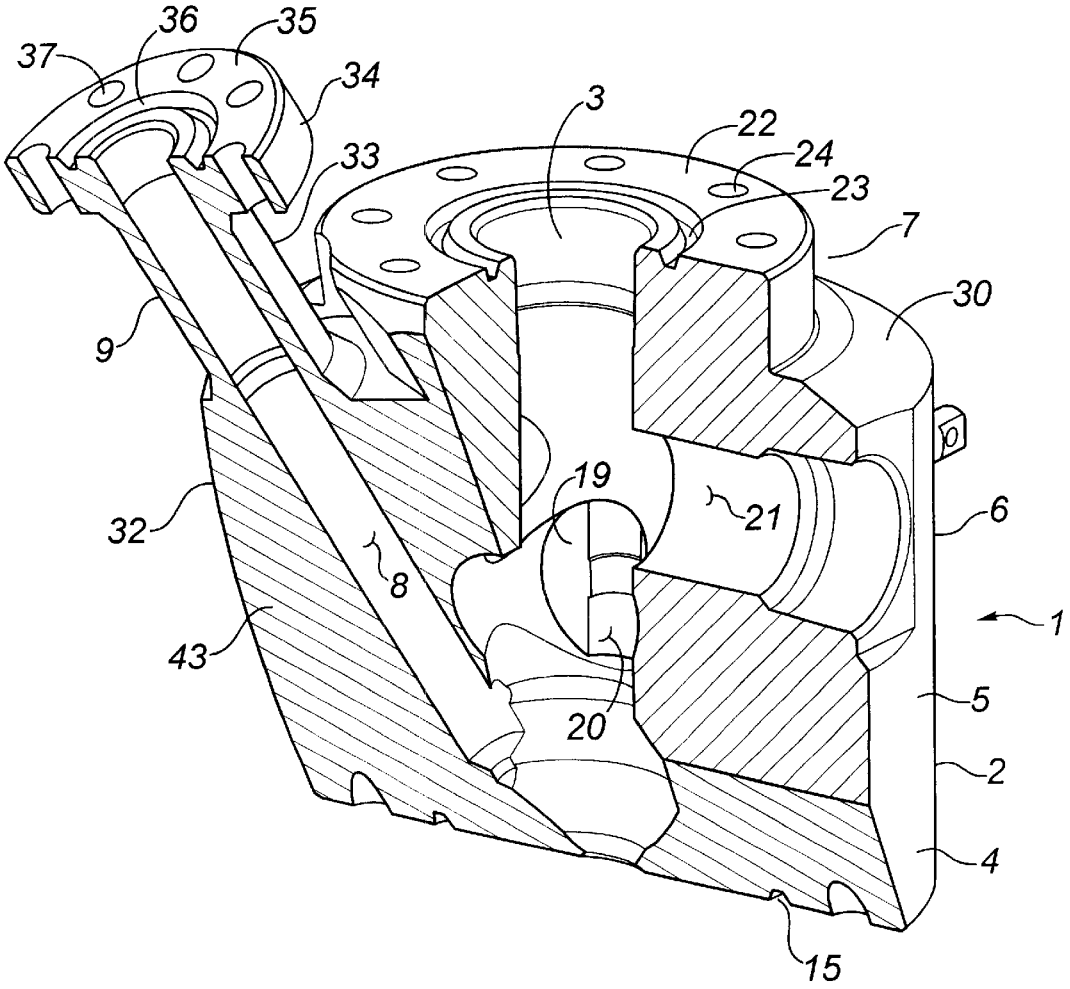
FIG. 2 is a cross-sectional side view of a composite pumping tree in accordance with the invention, equipped with an access port and an inlet pipe for enabling insertion of coiled tubing into the bore of a tubing string.

In one embodiment of the invention, shown in FIG. 2, an angled access port 8 extends downwardly and inwardly through the housing side wall 43 from the housing's outer side surface 32, commencing at the shoulder 30, to connect or communicate with the vertical bore 3. A pipe 33 extends upwardly and outwardly from the shoulder 30, to form an extension of the access port 8. The pipe 33 may be formed as part of the casting or forging or may be a separate nipple. The pipe 33 has a studded flanged connection 34 at its upper end. The end face 35 of the connection 34 forms a ring seal groove 36 for receiving seal ring (not shown). The body of the connection 34 forms threaded bolt holes 37 for receiving studs for attaching the connection 34 with a control valve (not shown).

Figure 4:
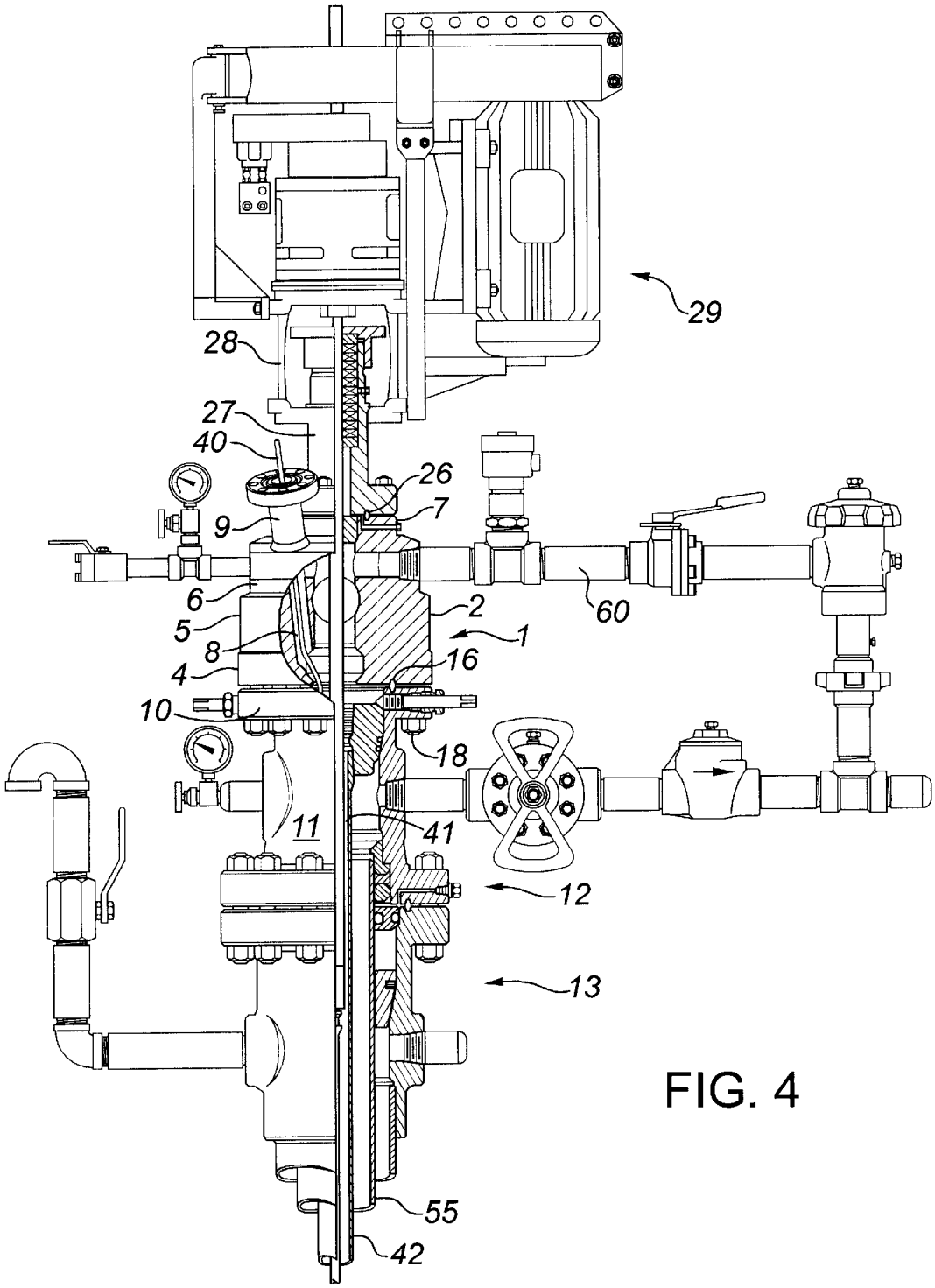
FIG. 4 is a cross-sectional side view showing the tree of FIG. 2 forming part of a wellhead with a string of coiled tubing extending through the access port into the bore of the tubing string.

As shown in FIG. 4, coiled tubing 40 can be inserted through the control valve, pipe 33 and access port 8, to enter the bore 41 of a tubing string 42 suspended from the wellhead 12. This can be accomplished without removing the rotary drive assembly 29.

Figure 3:
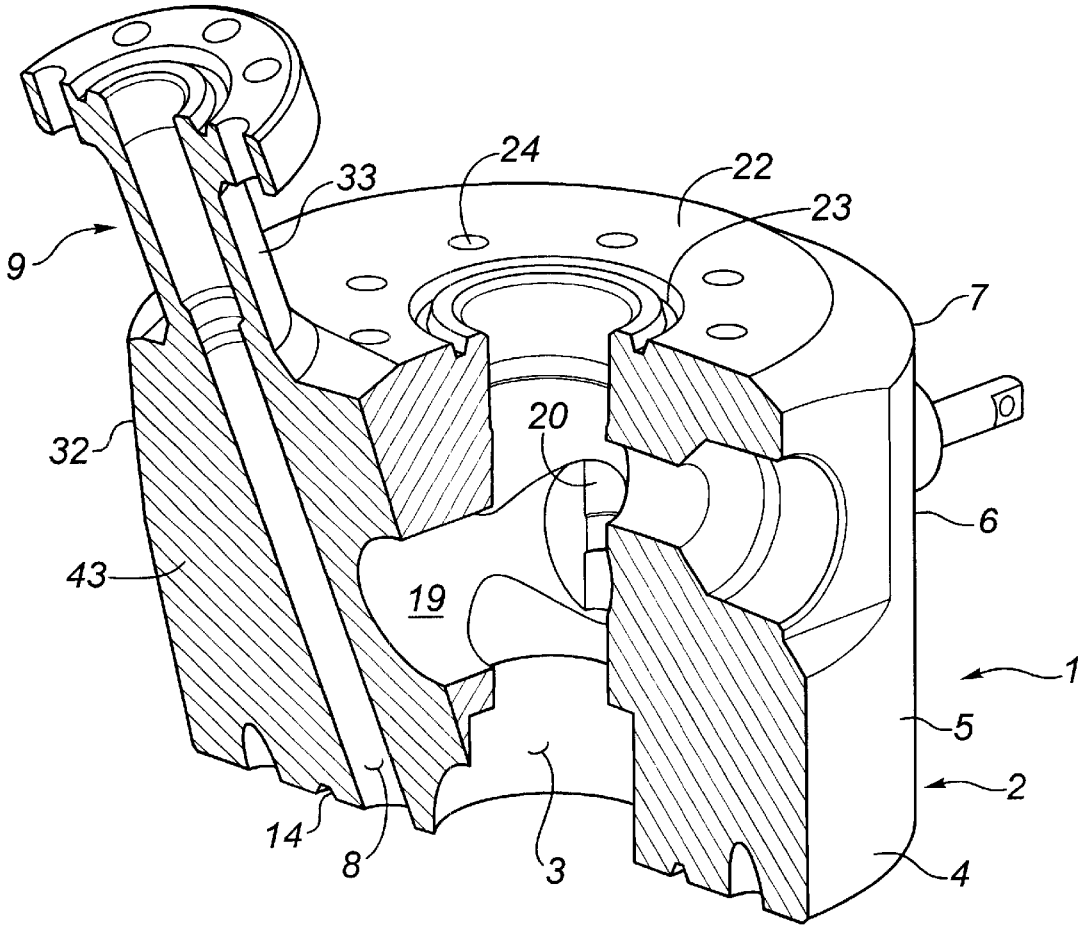
FIG. 3 is a cross-sectional side view of a tree equipped with an access port and an inlet pipe for enabling insertion of coiled tubing into the annulus between the tubing and production casing strings.
Figure 5:
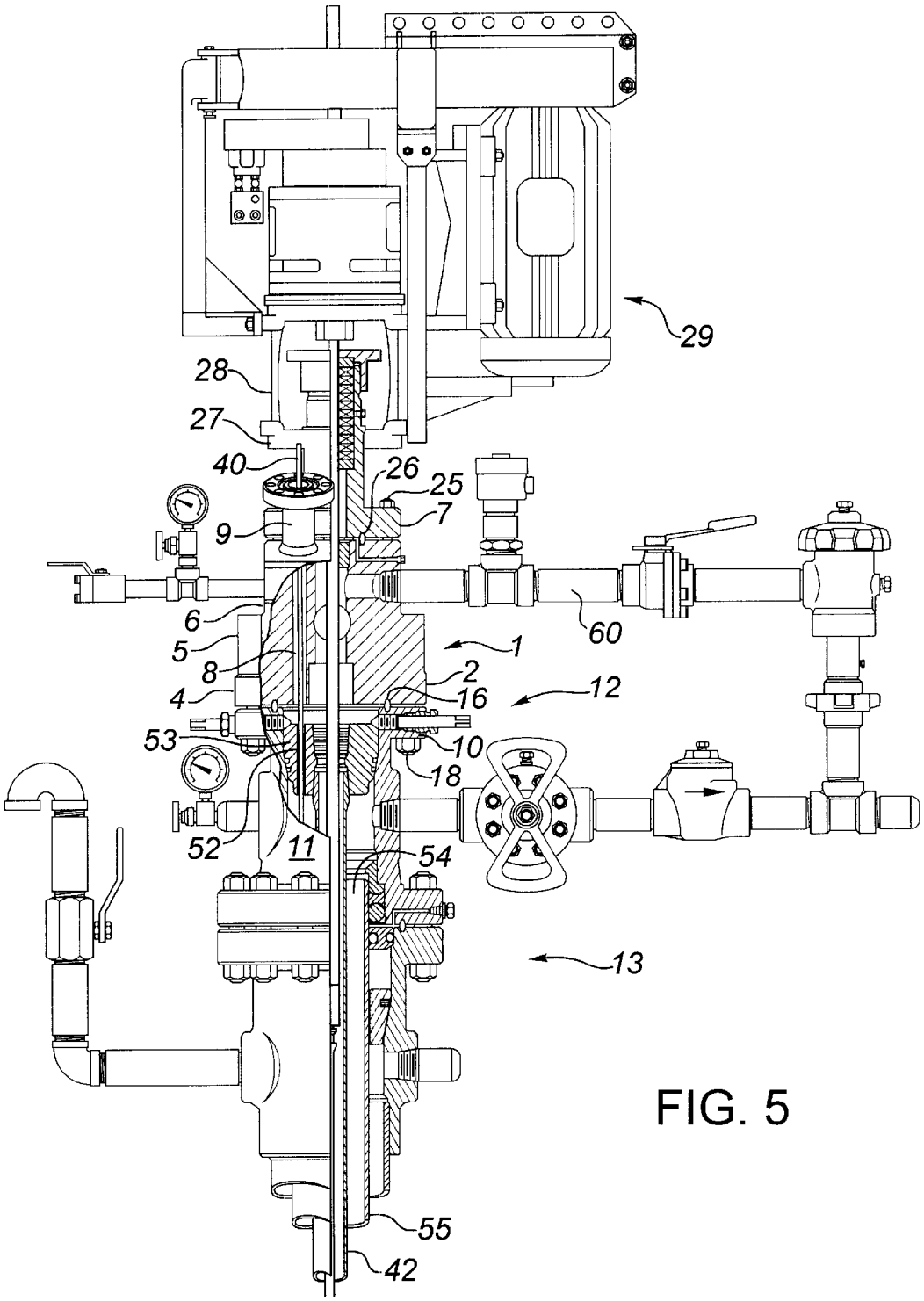
FIG. 5 is a cross-sectional side view showing the tree of FIG. 3 forming part of a wellhead with a string of coiled tubing extending through the access port into the annulus.

In another embodiment of the invention, shown in FIG. 3, an access port 8 extends down, through the housing side wall 43, from the housing's outer side surface 32 and terminates at the bottom end face 14 of the bottom connection 4, inwardly of the seal ring 16. A pipe 33, as previously described, extends up from the access port 8. As shown in FIG. 5, the access port 8 enables coiled tubing 40 to extend down through an opening 52 in the tubing string hanger 53, so as to enter the annulus 54 between the tubing string 42 and the production casing string 55.

The Figures and description set forth applicants' best modes of the invention. However those skilled in the art will realize that various alterations can be made without altering the substance of the invention. For example, a ring-type connection can be substituted for the studded bottom connection. The scope of the invention is set forth in the claims now following.

The embodiments of the invention in which an exclusive property or privilege is claimed are defined as follows:

1. A composite pumping tree for use in a wellhead between a tubing head top connection and the bottom connection of a pump drive and seal assembly, said wellhead supporting a tubing string having a bore and production casing combining with the tubing string to form an annulus, comprising:

a housing formed from a single piece of steel, said housing forming a vertical bore extending therethrough and having a side wall and an outer side surface, said housing further comprising a bottom connection for connecting with the tubing head top connection, a blow-out preventer housing section forming side openings, communicating with the vertical bore, for receiving the ram components of a blow-out preventer, a flow tee section forming at least one side opening, communicating with the vertical bore, for producing well fluid, a top connection for connecting with the pump drive and seal assembly bottom connection, said housing side wall forming an access port extending inwardly and downwardly therethrough from the housing side surface for connection with the tubing string bore or the tubing/casing annulus.

2. The pumping tree as set forth in claim 1 wherein:

the access port connects with the vertical bore and therethrough with the tubing string bore.

3. The pumping tree as set forth in claim 1 wherein:

the access port extends to the bottom surface of the pumping tree to enable communication with the tubing/casing annulus.

* * * * *